United States Patent [19]

Kurematsu et al.

[11] Patent Number: 4,748,474

[45] Date of Patent: May 31, 1988

[54] IMAGE FORMING METHOD AND APPARATUS USING DEVELOPER HAVING TONER GENERALLY FROM ONE TO FIVE MICRONS IN SIZE AND A LUBRICANT

[75] Inventors: Katsumi Kurematsu, Kawasaki; Kenichi Takeda; Yuji Sakemi, both of Yokohama, all of Japan

[73] Assignee: Canon Kabushiki Kaisha, Tokyo, Japan

[21] Appl. No.: 899,400

[22] Filed: Aug. 22, 1986

[30] Foreign Application Priority Data

Aug. 27, 1985 [JP] Japan ..... 60-186673

[51] Int. Cl.[4] ..... G03G 21/00

[52] U.S. Cl. ..... 355/15; 355/3 DD; 430/110; 430/111; 430/125

[58] Field of Search ..... 355/15, 3 DD, 77; 430/105, 107, 110, 111, 125

[56] References Cited

U.S. PATENT DOCUMENTS

| | | | |
|---|---|---|---|
| 3,609,082 | 9/1971 | Moriconi et al. | 430/110 |
| 3,817,868 | 6/1974 | Van Besauw | 430/110 |
| 3,964,903 | 6/1976 | Van Besauw | 430/110 X |
| 3,983,045 | 9/1976 | Jugle et al. | 430/110 |
| 4,248,950 | 2/1981 | Westdale | 430/110 |
| 4,331,756 | 5/1982 | Mayer et al. | 430/110 |
| 4,397,941 | 8/1983 | Fickes | 430/110 X |
| 4,639,123 | 1/1987 | Adachi et al. | 355/15 |

*Primary Examiner*—R. L. Moses

*Attorney, Agent, or Firm*—Fitzpatrick, Cella, Harper & Scinto

[57] ABSTRACT

An image forming method and apparatus using an image bearing member, movable along an endless path, for bearing a toner image and having a critical surface tension of not more than 33 dyne/cm, wherein, the toner image formed on the image bearing member by a developer containing toner not less than 70% of which has a particle size of 1–5 microns, and lubricant in an amount not less than 0.5% by weight of the toner, and the image bearing member is cleaned by removing the toner image remaining on the image bearing member.

10 Claims, 1 Drawing Sheet

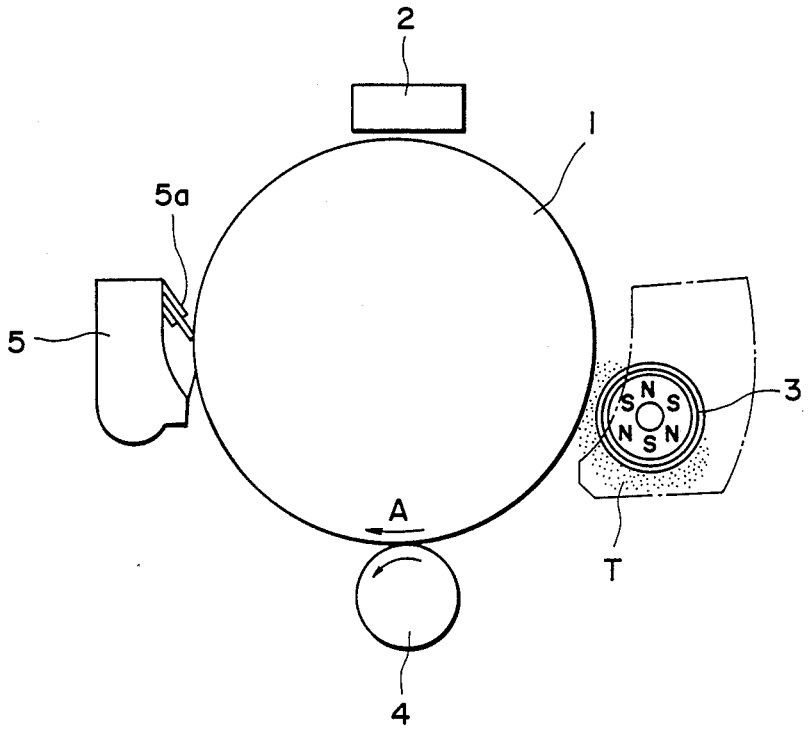
2
1
5a
5
3
S N S
N S N
A
T
4

IMAGE FORMING METHOD AND APPARATUS USING DEVELOPER HAVING TONER GENERALLY FROM ONE TO FIVE MICRONS IN SIZE AND A LUBRICANT

FIELD OF THE INVENTION AND RELATED ART

The present invention relates to an image forming method usable in an image forming apparatus such as a copying machine and a printer, more particularly, an image forming method using toner powder as a developer.

In the method of forming an image wherein an electrostatic latent image is formed on an image bearing member, and wherein electrically charged fine toner powder is deposited to the latent image to visualize it, it is readily expected that the image is made sharper by decreasing the size of the toner particles.

However, with the decrease of the toner particle size, the force for the toner particles to attach to the image bearing member increases with the result of difficulty in removing it from the image bearing member for cleaning after image transfer onto a transfer sheet. In consideration of this, it is usual to use toner having a particle size of approximately 10 microns.

On the other hand, it has been confirmed that fine images can be provided when a known electrophotographic machine and fine toner powder is used. In the confirmed copying machine, an electrostatic latent image on an image bearing member is opposed to a developing device, more particularly to a sleeve containing therein a magnet. The toner particles are transferred from the sleeve to the latent image. The developer contains magnetic (carrier) particles containing not less than 40 wt.% of the magnetic material and toner particles mainly consisting of resin and having a particle size of 1–5 microns, which are mixed together. The developer is formed into a magnetic brush on the sleeve surface at the developing position. The strength of the magnetic field in the tangential direction of the sleeve surface at the developing station is not less than 200 Gausses, wherein the clearance between the surface of the image bearing member and the surface of the sleeve is maintained larger than the height of the magnetic brush. Across the clearance therebetween, an alternating electric field is formed. The magnetic carrier particles are maintained on the sleeve surface. From the surfaces of the magnetic carrier particles, the toner is transferred to the image and non-image area of the image bearing member surface. The unwanted toner particles are transferred back to the sleeve. By the application of the alternating field, this operation is repeated. The resolution of the image has been 10 lines/mm when this toner (1–5 microns) is used, while it is 5 lines/mm when the particle size of the toner is approximately 10 microns.

However, when the small particle size toner is used, the force for the toner particles to attach to the image bearing member surface is remarkably increased, and particularly, it has been confirmed that it is almost impossible to remove the toner particles having the particle size not more than 5 microns in the cleaning step.

SUMMARY OF THE INVENTION

Accordingly, it is a principal object of the present invention to provide an image forming process wherein the resolution and the sharpness is increased, and simultaneously, the cleaning is easy, in view of the above-described problem of the prior art.

According to an embodiment of the present invention, there is provided an image forming method using an image bearing member, movable along an endless path, for bearing a toner image, comprising: forming a toner image on said image bearing member by a developer; and cleaning said image bearing member by removing the toner image remaining on said image bearing member; wherein a lubricant and toner particles having a particle size of 1–5 microns are contained as components of the developer.

These and other objects, features and advantages of the present invention will become more apparent upon a consideration of the following description of the preferred embodiments of the present invention taken in conjunction with the accompanying drawings.

BRIEF DESCRIPTION OF THE DRAWING

The FIGURE is a schematic sectional view of an image forming apparatus in which the present invention can be embodied.

DETAILED DESCRIPTION OF THE PREFERRED EMBODIMENTS

The FIGURE illustrates an image forming apparatus to which an image forming process according to an embodiment of the present invention is applicable, as an example. Around an image bearing member 1 in the form of a drum rotatable along an endless path in the direction of an arrow A, there are provided known electrostatic latent image forming means 2, a developing sleeve, a transfer roller 4 for transferring the toner image onto a recording sheet or paper (if necessary, the image is simultaneously pressure-fixed) and a cleaning device 5 provided with a cleaning blade 5*a* to remove from the image bearing member 1 surface the toner not transferred onto a transfer material and remaining on the image bearing member 1 surface. The developing device comprises a developer container 6 for containing the developer T and a developing sleeve 3 in the container.

The following Tables show the results of experiments regarding the cleaning property when the critical surface tension is changed by using different materials or when the critical surface tension is changed from 20–40 dyne/cm by changing the amount of Teflon (Trade name) in the surface of the image bearing member 1 formed by epoxyacrylate resin in which Teflon is dispersed. The critical surface tension is the value at the normal temperature. As for the toner particles, two component developers containing not less than 90% of toner particles having particle size of 1–5 microns, mixed with magnetic carrier particles were used. Into the developer, 0.1–2.0 wt.% (to the toner particles) of zinc stearate powder has been added as a lubricant, as indicated in the Tables.

TABLE 1

| IMAGE BEARING MEMBER | | TONER LUBRICANT (ZINC STEARATE) (wt. %) | | | | |
|---|---|---|---|---|---|---|
| MATERIAL | CRITICAL SURFACE TENSION (dyne/cm) | 0.1 | 0.3 | 0.5 | 1.0 | 2.0 |
| NYLON 66 | 46 | N | N | N | N | N |
| MYLAR | 43 | N | N | N | N | N |
| VINYL CHLORIDE | 39 | N | N | N | N | N |
| POLYSTYRENE | 33 | N | N | G | G | G |

TABLE 1-continued

| IMAGE BEARING MEMBER | | | | | | |
|---|---|---|---|---|---|---|
| MATERIAL | CRITICAL SURFACE TENSION (dyne/cm) | TONER LUBRICANT (ZINC STEARATE) (wt. %) 0.1 | 0.3 | 0.5 | 1.0 | 2.0 |
| POLYETHYLENE | 31 | N | N | G | G | G |
| TEFLON | 18 | N | P | G | G | G |

TABLE 2

| IMAGE BEARING MEMBER | | TONER LUBRICANT (ZINC STEARATE) (wt. %) | | |
|---|---|---|---|---|
| TEFLON (wt. %) | CRITICAL SURFACE TENSION (dyne/cm) | 0.1 | 0.5 | 1.0 |
| 0 | 40 | N | N | N |
| 3 | 31 | N | G | G |
| 5 | 25 | N | G | G |

In the Tables, G represents good cleaning; N represents unsatisfactory cleaning; and P represents that unsatisfactory cleaning sometimes occurs.

As will be understood from Table 1, the satisfactory cleaning property can be provided by the critical surface tension of not more than 33 dyne/cm by using an amount of lubricant not less than 0.5% by weight with respect to the toner. It is understood that this effect results from the combination of the added lubricant and the reduced surface energy of the image bearing member, and when both are larger than the above values, respectively, the lubricating property remarkably increases.

As for the lubricant, it has been confirmed that Teflon, fluorocarbon resin, vinylidene fluoride, silicon oil may be used with similar results.

Also, it has been confirmed that similar results are provided when the fine toner particles (1–5 microns are not less than 70% by weight.

In the above described embodiment, the used developer is mixture of the toner particles and the lubricant particles. However, each toner particle may contain the lubricant, rather than being mixed together. It has been confirmed that the results are similar to those shown in Tables 1 and 2. When, however, this is adopted, it is preferable that at least a part of the lubricant appears on the surface of the toner particle. It is added that the particle size of the lubricant is not more than 1/100 of the particle size of the toner particles, so that the increase of the particle size of the toner by including the lubricant is substantially negligible.

The image bearing member has been described as being an electrophotographic photosensitive member having a surface layer of an insulating material as used in an electrophotographic process as disclosed in U.S. Pat. Nos. 3,666,363 and 3,438,706 (so-called NP process). However, it has also been confirmed that the present invention is applicable to other image bearing members such as are usable with the so-called Carlson process or a process wherein the latent image to be developed is formed on an insulating member by directly applying electric charge imagewisely as in a process using a multi-stylus or ion generator (U.S. Pat. No. 4,155,093 to Fotland et al.), if the surface for the image bearing member has a surface tension of not more than 33 dyne/cm.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

an image bearing member, movable along an endless path, for bearing a toner image, said image bearing member having a surface with a critical surface tension of not more than 33 dyne/cm;

means for forming a toner image on said image bearing member by applying a developer, the developer containing toner, not less than 70% by weight of which has particles from 1 to 5 microns in size, and not less than 0.5% by weight of a lubricant based on the weight of the toner; and means for cleaning said image bearing member by removing the toner image remaining on said image bearing member.

2. An apparatus according to claim 1, wherein said cleaning means comprises a cleaning blade.

3. A method according to claim 1, wherein not less than 90% of the toner particles constituting the developer have the particle size of 1–5 microns.

4. An apparatus according to claim 1, wherein the toner particles and the lubricant, in the form of particles, are mixed together.

5. An apparatus according to claim 1, wherein each of the toner particles contains lubricant.

6. An image forming method comprising:

providing an image bearing member movable along an endless path and having a surface with a critical surface tension of not more than 33 dyne/cm;

forming a toner image on said image bearing member by applying a developer containing toner, not less than 70% by weight of which has particles from 1 to 5 microns in size, and not less than 0.5% by weight of a lubricant based on the weight of the toner; and cleaning said image bearing member by removing the toner image remaining on said image bearing member.

7. A method according to claim 6, wherein said cleaning is effected by a cleaning blade.

8. A method according to claim 6, wherein not less than 90% of the toner particles constituting the developer have the particle size of 1–5 microns.

9. A method according to claim 6, wherein the toner particles and the lubricant, in the form of particles, are mixed together.

10. A method according to claim 6, wherein each of the toner particles contains lubricant.

* * * * *

UNITED STATES PATENT AND TRADEMARK OFFICE

CERTIFICATE OF CORRECTION

PATENT NO. : 4,748,474

DATED : May 31, 1988

INVENTOR(S) : KATSUMI KUREMATSU, ET AL.

It is certified that error appears in the above-identified patent and that said Letters Patent is hereby corrected as shown below:

COLUMN 1

Line 41, "direction of" should read --direction to--.

COLUMN 2

Line 33, "sleeve," should read --sleeve 3,--.
Table 1, line 67, for Vinyl Chloride, in the column for 2.0% zinc stearate, "N" should read --P--.

COLUMN 3

Line 37, "(1-5 microns" should read --(1-5 microns)--.

COLUMN 4

Line 1, "imagewisely" should read --imagewise--.
Line 29, "A method" should read --An apparatus--.

Signed and Sealed this

Thirty-first Day of October, 1989

*Attest:*

DONALD J. QUIGG

*Attesting Officer*

*Commissioner of Patents and Trademarks*